US009731497B2

(12) United States Patent
Nishi

(10) Patent No.: US 9,731,497 B2
(45) Date of Patent: Aug. 15, 2017

(54) PRINTING PAPER AND METHOD FOR PRODUCING PRINTED MATERIAL

(71) Applicant: MITSUBISHI PAPER MILLS LIMITED, Tokyo (JP)

(72) Inventor: Tetsuya Nishi, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 15/045,498

(22) Filed: Feb. 17, 2016

(65) Prior Publication Data

US 2016/0271984 A1 Sep. 22, 2016

(30) Foreign Application Priority Data

Mar. 18, 2015 (JP) ..... 2015-054091
Nov. 18, 2015 (JP) ..... 2015-225870

(51) Int. Cl.

| | |
|---|---|
| ***B41F 11/00*** | (2006.01) |
| ***D21C 9/10*** | (2006.01) |
| ***B41M 5/50*** | (2006.01) |
| *B41M 5/52* | (2006.01) |

(52) U.S. Cl.

CPC ..... *B41F 11/00* (2013.01); *B41M 5/508* (2013.01); *B41M 5/5218* (2013.01); *B41M 5/5245* (2013.01); *D21C 9/10* (2013.01); *B41M 5/52* (2013.01); *B41M 5/5254* (2013.01); *B41M 5/5263* (2013.01)

(58) Field of Classification Search

CPC ..... B41M 5/00; B41M 5/50; B41M 5/5218; B41M 5/5245; D21C 9/10

See application file for complete search history.

(56) References Cited

U.S. PATENT DOCUMENTS

| | | | | |
|---|---|---|---|---|
| 6,632,488 | B2 * | 10/2003 | Okumura | B41M 5/52 428/32.18 |
| 2002/0123728 | A1 * | 9/2002 | Graef | A61F 13/5376 604/375 |
| 2011/0187802 | A1 | 8/2011 | Fujio et al. | |

FOREIGN PATENT DOCUMENTS

| | | | |
|---|---|---|---|
| JP | 2002-326453 | A | 11/2002 |
| JP | 2004-358731 | A | 12/2004 |
| JP | 2008-126559 | A | 6/2008 |
| JP | 2011-157168 | A | 8/2011 |
| JP | 2013-104147 | A | 5/2013 |

* cited by examiner

*Primary Examiner* — Betelhem Shewareged
(74) *Attorney, Agent, or Firm* — Birch, Stewart, Kolasch & Birch, LLP

(57) ABSTRACT

Printing paper is provided that is able to inhibit the occurrence of cockling and wrinkling during printing and inhibit the occurrence of curling after printing when cut into sheets in the case where inkjet printing is carried out in a rotary inkjet printing press while tension is applied from the time the printing paper is rolled out until it is taken up. The printing paper comprises a base paper and a coating layer containing a pigment and a binder on at least one side of the base paper, wherein an ash content of the base paper is 20% by weight to 30% by weight, and specific tensile strength of the printing paper in the CD direction is 9.0 N·m/g or less, and the ratio of (specific tensile strength in the MD direction)/(specific tensile strength in the CD direction) is 1.9 to 2.3, wherein the specific tensile strength is as determined basically in compliance with JIS P 8113:2006.

8 Claims, No Drawings

PRINTING PAPER AND METHOD FOR PRODUCING PRINTED MATERIAL

CROSS-REFERENCE TO RELATED APPLICATIONS

The present application claims priorities to Japanese Patent Application Nos. 2015-054091, filed Mar. 18, 2015 and 2015-225870, filed Nov. 18, 2015. The contents of these applications are incorporated herein by reference in their entirety.

BACKGROUND OF THE INVENTION

Field of the Invention

The present invention relates to printing paper used in a rotary inkjet printing press and to a method for producing a printed material that uses that printing paper.

Description of Related Art

A rotary type of inkjet printing press has been disclosed that is able to accommodate plateless printing and on-demand printing (see, for example, Patent Document 1).

Inkjet recording paper of the plain paper type is known that demonstrates superior water-based ink absorption drying properties and can be used in printing systems using a high-speed rotary inkjet recording system, is produced by coating a mixture of a cationic polymer compound and water-soluble binder onto at least one side of base paper mainly composed of wood pulp or non-wood pulp and obtained by forming into paper from a pulp slurry containing 0.15% by weight to 0.20% by weight of an internal sizing agent based on the total weight of the pulp (see, for example, Patent Document 2).

In addition, coated printing paper is known that is provided with favorable ink settability in a rotary inkjet printing system while maintaining offset printability, has a coating layer, which is mainly composed of latex and pigment having oil absorbency as determined according to JIS K 5101-13-2:2004 of 100 ml/100 g or less, provided on at least one side of base paper containing a cationic resin, and contains 0.05 g/m$^2$ to 2 g/m$^2$ per side of a surfactant in the coating layer (see, for example Patent Document 3).

PATENT DOCUMENTS

Patent Document 1: Japanese Unexamined Patent Publication No. 2011-157168

Patent Document 2: Japanese Unexamined Patent Publication No. 2008-126559

Patent Document 3: Japanese Unexamined Patent Publication No. 2013-104147

BRIEF SUMMARY OF THE INVENTION

In such rotary inkjet printing presses, tension is applied from the time the printing paper is rolled out until it is taken up in order to carry out printing. Printing paper goes through an inkjet printing step and drying step during the time it is rolled out until it is taken up. When inkjet printing is carried out while tension is applied, the printing paper may demonstrate waving and wrinkling in a form that runs parallel to the direction in which the paper is transported. Since the specific tensile strength of paper is normally greater in the machine direction (MD) in comparison with the cross direction (CD), paper is taken up along the MD direction. Thus, waving phenomenon (cockling) and wrinkles occur easily in a form that runs parallel to the direction in which the paper is transported. This is because the ink used in inkjet printing presses contains solvents such as water and drying preventive agents such as glycerin in relatively large amounts in comparison with ink used in offset printing presses and the like based on the principle of the discharging of ink droplets that characterizes inkjet printing presses. In addition, printing paper may demonstrate curling when released from the rolled state and cut into sheets after printing.

An object of the present invention is to provide printing paper that is able to inhibit the occurrence of cockling and wrinkling during printing and inhibit the occurrence of curling after printing when cut into sheets, in the case where inkjet printing is carried out in a rotary type of inkjet printing press while tension is applied from the time the printing paper is rolled out until it is taken up.

Another object of the present invention is to provide a method for producing a printed material using an industrial rotary inkjet printing press that enables the production of a printed material in which the occurrence of cockling and wrinkling during printing is inhibited and the occurrence of curling after printing when released from the rolled state and is also inhibited, in the case where inkjet printing is carried out in a rotary type of inkjet printing press while tension is applied from the time the printing paper is rolled out until it is taken up.

The objects of the present invention are achieved in the manner described below.

(1) Printing paper comprising:

a base paper and a coating layer containing a pigment and a binder on at least one side of the base paper, wherein an ash content of the base paper is 20% by weight to 30% by weight, and specific tensile strength of the printing paper in the CD direction is 9.0 N·m/g or less, and the ratio of (specific tensile strength in the MD direction)/(specific tensile strength in the CD direction) is 1.9 to 2.3, wherein the specific tensile strength is as determined basically in compliance with Japanese Industrial Standard JIS P 8113:2006.

(2) The printing paper described in (1) above, wherein the base paper contains at least leaf bleached kraft pulp (LBKP) and needle bleached kraft pulp (NBKP) as pulp, and the relationship of the freeness of the LBKP and NBKP as determined basically in compliance with the "Canada Standard Freeness Method" of *Japanese Industrial Standard* JIS P 8121-2:2012 is such that (LBKP freeness)<(NBKP freeness).

(3) The printing paper described in (1) or (2) above, wherein the coating layer contains a water-soluble polyvalent cation salt.

(4) A method for producing a printed material, comprising the steps of:

obtaining the printing paper described in any of (1) to (3) above, and obtaining a printed material by printing on the printing paper with an industrial rotary inkjet printing press.

According to the present invention, printing paper can be provided that inhibits the occurrence of cockling and wrinkling during printing and inhibits the occurrence of curling after printing when cut into sheets, in the case where inkjet printing is carried out in a rotary inkjet printing press while tension is applied from the time the printing paper is rolled out until it is taken up. In addition, according to the present invention, a method for producing a printed material that uses an industrial rotary inkjet printing press can be provided that enables the production of a printed material in which the occurrence of cockling and wrinkling during printing is inhibited and the occurrence of curling after printing when released from the rolled state and cut into sheets is also inhibited, in the case where inkjet printing is carried out in a rotary inkjet printing press while tension is applied from the time the printing paper is rolled out until it is taken up.

DETAILED DESCRIPTION OF THE INVENTION

The following provides a detailed explanation of the present invention.

As used herein, the term "inkjet printing" means printing using an industrial rotary inkjet printing press. Rotary inkjet printing presses are described, for example in Patent Document 1 (Japanese Unexamined Patent Publication No. 2011-157168), and are already commercially available, and examples thereof include the "HP T300 Color Inkjet Web Press" large-scale inkjet printing press manufactured by the Hewlett-Packard Co., the "MJP20 Series" and "MJP30 Series" of inkjet printing presses manufactured by Miyakoshi Printing Machinery, Co., Ltd., and the "Kodak Prosper 5000XL Press" high-speed color inkjet digital rotary printing press manufactured by the Eastman Kodak Co.

The basis weight of the printing paper is preferably 70 $g/m^2$ or less and more preferably 60 $g/m^2$ or less. This is because the effects of the present invention are demonstrated more prominently if basis weight is within this range. Furthermore, although there are no particular limitations on the lower limit of basis weight, basis weight is normally within a range that allows use as printing paper. Basis weight is preferably 35 $g/m^2$ or more.

The thickness of the printing paper is preferably 70 μm or less. This is because the effects of the present invention are more prominently demonstrated if thickness is within this range. Although there are no particular limitations on the lower limit of thickness, thickness is normally within a range that allows use as printing paper. Thickness is preferably 45 μm or more.

Specific tensile strength of the present invention refers to the value of specific tensile strength as determined basically in compliance with HS P 8113:2006. More specifically, the specific tensile strength is determined as mentioned below. The test sample is subject to humidity preconditioning treatment by still standing the test sample under the environment at 23° C. and 50% RH for 24 hours. The basis weight of the test sample is measured under the environment at 23° C. and 50% RH. Tensile test is carried out under the environment at 23° C. and 50% RH to obtain the specific tensile strength. Specific tensile strength of the printing paper of the present invention in the CD direction is 9.0 N·m/g or less. Specific tensile strength of the printing paper in the CD direction is preferably 7.0 N·m/g to 9.0 N·m/g. If specific tensile strength in the CD direction is outside this range, inhibition of at least one of the occurrence of cockling, and wrinkling and the occurrence of curling after printing when released from the rolled state and cut into sheets is inadequate, in the case where inkjet printing is carried out in a rotary inkjet printing press while tension is applied from the time the printing paper is rolled out until it is taken up.

The ratio of (specific tensile strength in the MD direction)/(specific tensile strength in the CD direction) of the printing paper of the present invention is 1.9 to 2.3, preferably 1.9 to 2.2, and more preferably 2.0 to 2.2. If outside this range, inhibition of at least one of the occurrence of cockling and wrinkling and the occurrence of curling after printing when released from the rolled state and cut into sheets is inadequate, in the case where inkjet printing is carried out in a rotary inkjet printing press while tension is applied from the time the printing paper is rolled out until it is taken up.

The base paper is paper that is made under acidic papermaking, neutral papermaking or alkaline papermaking condition from paper stock containing at least one type of chemical pulp such as leaf bleached kraft pulp (LBKP) or needle bleached kraft pulp (NBKP), mechanical pulp such as groundwood pulp (GP), pressure groundwood pulp (PGW), refiner mechanical pulp (RMP), thermomechanical pulp (TMP), chemithermomechanical pulp (CTMP), chemimechanical pulp (CMP) or chemigroundwood pulp (CGP), or waste paper pulp such as deinked pulp (DIP), a filler such as calcium carbonate, and various types of additives such as a sizing agent, retention aid, cationic compound, pigment dispersant, thickener, fluidity improver, defoamer, antifoamer, releasing agent, foaming agent, penetrant, coloring dye, coloring pigment, optical brightener, ultraviolet absorber, antioxidant, preservative, anti-mold agent, insolubilizer, wet paper strength enhancer or dry paper strength enhancer as necessary. The aforementioned paper may be subjected to calendering treatment using a calendering device to be subsequently described following papermaking.

The base paper preferably contains at least LBKP and NBKP as pulp. In addition, the relationship of the freeness of the LBKP and NBKP as determined basically in compliance with the "Canada Standard Freeness Method" of JIS P 8121-2:2012 is such that (LBKP freeness)<(NBKP freeness). The reason for this is that when the printing paper has a lower basis weight (for example, 35 $g/m^2$ to less than 50 $g/m^2$) or reduced thickness, the occurrence of cockling and wrinkling and the occurrence of curling after printing when released from the rolled state and cut into sheets can be inhibited, in the case where inkjet printing is carried out in a rotary inkjet printing press while tension is applied from the time the printing paper is rolled out until it is taken up. Here, the ratio of LBKP:NBKP is preferably within the range of 90:10 to 60:40, more preferably within the range of 80:20 to 60:40, and further preferably within the range of 75:25 to 60:40. The freeness of the LBKP and NBKP is preferably within the range of 400 ml to 540 ml, more preferably within the range of 430 ml to 520 ml, and further preferably within the range of 450 ml to 520 ml.

In the present invention, the sizing degree of the base paper may be any sizing degree provided it does not impair the desired effects of the present invention. Sizing degree can be adjusted according to the amount of internal sizing agent incorporated in the base paper or the amount of surface sizing agent coated onto the base paper. Examples of internal sizing agents include rosin-based sizing agents, alkenyl succinic anhydrides, alkyl ketene dimer, neutral rosin-based sizing agents and cationic styrene-acrylic-based sizing agents. Examples of surface sizing agents include styrene-acrylic-based sizing agents, olefin-based sizing agents and styrene-maleic acid-based sizing agents.

Ash content refers to the ratio (wt %) of the weight of incombustible matter after subjecting base paper to combustion treatment for 1 hour at 500° C. to the bone dry weight of the base paper prior to combustion treatment. The ash content of the base paper is 20% by weight to 30% by weight, and preferably more than 20% by weight and less than 30% by weight. Ash content can be adjusted according by increasing or decreasing filler content. In this technical art, it is often the case that ash content is normally less than 15% by weight. When the ash content of the base paper is increased, impaired effects such as decrease in water resistance of the base paper and increase in abrasion of equipment for papermaking generally occur. By adjusting the ash content of the base paper in the range of 20% by weight to 30% by weight which is relatively high content, it makes possible to easily adjust the specific tensile strength in CD direction to less than 9.0 N·m/g, and further, the occurrence of curl after printing when released from the rolled state and cut into sheets can be inhibited, in the case where inkjet printing is carried out in a rotary inkjet printing press while tension is applied from the time the printing paper is rolled out until it is taken up. The reason for this may be presumed that the filler is adsorbed onto the fibers of pulp, thereby decreasing interactions between pulp fibers.

The coating layer contains pigment and binder.

The pigment is at least one type selected from pigments conventionally known in the field of papermaking. Examples of pigments include inorganic pigments such as kaolin, calcium carbonate, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, aluminum hydroxide, alumina, lithopone, zeolite, magnesium carbonate or magnesium hydroxide, and organic pigments such as styrene-based plastic pigments, acrylic-based plastic pigments, styrene-acrylic-based plastic pigments, polyethylene, microcapsules, urea resin or melamine resin.

The binder is at least one type selected from water-dispersible binders and water-soluble binders conventionally known in the field of papermaking. Examples of water-dispersible binders include conjugated diene-based copolymer latex such as styrene-butadiene copolymer or acrylonitrile-butadiene copolymer, acrylic-based copolymer latex such as polymers of acrylic acid esters or methacrylic acid esters or methyl methacrylate-butadiene copolymer, vinyl-based copolymer latex such as ethylene-vinyl acetate copolymer or vinyl chloride-vinyl acetate copolymer, polyurethane resin latex, alkyd resin latex, unsaturated polyester resin latex, functional group-modified copolymer latex of these various polymers modified with a carboxyl group or other functional group-containing monomer, and thermosetting synthetic resins such as melamine resin or urea resin. Examples of water-soluble binders include starch derivatives such as oxidized starch, etherified starch or starch phosphate, cellulose derivatives such as methyl cellulose, carboxymethyl cellulose or hydroxyethyl cellulose, polyvinyl alcohol and polyvinyl alcohol derivatives such as silanol-modified polyvinyl alcohol, natural polymer resins and derivatives thereof such as casein, gelatin or modified gelatin, soybean protein, pullulan, gum arabic, karaya gum or albumin, vinyl polymers such as sodium polyacrylate, sodium alginate, polypropylene glycol, polyethylene glycol, maleic anhydride and copolymers thereof.

The coating layer of the present invention preferably contains a water-soluble polyvalent cation salt. The containing of a water-soluble polyvalent cation salt makes it possible to further inhibit the occurrence of cockling and wrinkling and to inhibit the occurrence of curling after printing when released from the rolled state and cut into sheets, in the case where inkjet printing is carried out in a rotary inkjet printing press while tension is applied from the time the printing paper is rolled out until it is taken up.

The water-soluble polyvalent cation salt refers to a water-soluble salt that contains a polyvalent metal cation. Namely, the water-soluble polyvalent cation salt is a salt that contains a polyvalent metal cation and dissolves to 1% by weight or more in water at 20° C. Examples of polyvalent metal cations include divalent cations such as magnesium, calcium, strontium, barium, nickel, zinc, copper, iron, cobalt, tin or manganese ions, trivalent cations such as aluminum, iron or chromium ions, tetravalent cations such as titanium or zirconium ions, and complex ions thereof. There are no particular limitations on the anion that forms a salt with the polyvalent metal cation, and may be an anion of an inorganic acid or organic acid. Examples of inorganic acids include hydrochloric acid, nitric acid, phosphoric acid, sulfuric acid, boric acid and hydrofluoric acid. Examples of organic acids include formic acid, acetic acid, lactic acid, citric acid, oxalic acid, succinic acid and organic sulfonic acids. However, aluminum sulfate that has been conventionally used as fixing agent for sizing agents is excluded from the water soluble polyvalent metal cations to be used in the present invention. Among these, water-soluble calcium salts are preferable. Calcium chloride and calcium nitrate are more preferable.

The coating layer can suitably contain additives conventionally known in the field of papermaking in addition to the aforementioned pigment, binder and water-soluble polyvalent cation salt, examples of which include dye fixing agents, pigment dispersants, thickeners, fluidity improvers, viscosity stabilizers, pH adjusters, surfactants, defoamers, antifoamers, releasing agents, foaming agents, penetrants, coloring dyes, coloring pigments, optical brighteners, ultraviolet absorbers, antioxidants, leveling agents, preservatives, anti-mold agents, insolubilizers, wet paper strength enhancers and dry paper strength enhancers.

The method used to provide the coating layer on the base paper preferably consists of coating a coating layer-coating color onto the base paper followed by drying. There are no particular limitations on the method used to coat the coating layer-coating color and may be a method that uses a conventionally known coating device.

Examples of coating devices include an air knife coater, curtain coater, slide lip coater, die coater, blade coater, Bill blade coater, short dwell blade coater, gate roll coater, film transfer coater, bar coater, rod coater, roll coater and size press. From the viewpoint of high-speed productivity, a blade coater, Bill blade coater, short dwell blade coater or film transfer coater is preferable. The coating device is more preferably a film transfer coater.

There are no particular limitations on the method used to dry the coating layer-coating color after coating and may be a method that uses a conventionally known drying device. Examples of drying devices include hot air dryers such as a straight tunnel dryer, arch dryer, air loop dryer or sine curve air flotation dryer, infrared heating dryers and dryers using microwaves.

After providing the coating layer, calendering treatment can be carried out as necessary using a machine calender, soft nip calender, super calender, multistage calender or multi-nip calender.

The method used to obtain the specific tensile strength in the CD direction or ratio of (specific tensile strength in the MD direction)/(specific tensile strength in the CD direction) of the present invention is conventionally known in the field of papermaking, and examples of methods used include adjusting base paper ash content, pulp freeness, and the ratio of pulp jet speed to Fourdrinier wire speed (J/W ratio) during papermaking.

Method for Producing Printed Material

The method for producing a printed material of the present invention comprises for the steps of: obtaining the aforementioned printing paper and obtaining a printed material by printing on the printing paper with an industrial rotary inkjet printing press. According to the printed material production method of the present invention, a printed material can be produced in which the occurrence of cockling and wrinkling is inhibited and the occurrence of curling after printing when released from the rolled state and cut into sheets is also inhibited, in the case where inkjet printing is carried out in a rotary inkjet printing press while tension is applied from the time the printing paper is rolled out until it is taken up. The printing paper and industrial rotary inkjet printing press are the same as the aforementioned printing paper and industrial rotary inkjet printing press, and duplicate explanations thereof are omitted.

The step of obtaining the aforementioned printing paper includes the production of printing paper and acquisition of the printing paper produced.

In the step of obtaining a printed material by printing on the printing paper with an industrial rotary inkjet printing press, the industrial rotary inkjet printing press preferably uses a water-based pigment ink from the viewpoint of weather resistance of the resulting printed material.

In the step of obtaining a printed material by printing on printing paper with an industrial rotary inkjet printing press, the printing speed is preferably greater than 100 m/min. Tensile strength of about 0.05 kN/m to 0.50 kN/m is applied with respect to the printing paper during printing from the time the printing paper is rolled out until it is taken up.

The printed material production method of the present invention may further comprise a step of printing on the aforementioned printing paper with a printing press selected from, for example, a gravure printing press, offset printing press, letterpress printing press and flexographic printing press before and/or after the step of printing with an industrial rotary inkjet printing press.

EXAMPLES

Although the following provides a more detailed explanation of the present invention through examples thereof, the present invention is not limited to the following examples provided the gist thereof is not exceeded. The terms "parts by weight" and "percent by weight" indicated in the examples indicate the values of dry solids or substantial components. In addition, coated amounts indicate the values of dry solids.

(Fabrication of Base Paper)

Paper stock, obtained by mixing a pulp slurry composed of a total of 100 parts by weight of LBKP and NBKP having the freeness described in Table 1 with a number of parts by weight of a filler in the form of precipitated calcium carbonate such that the ash content of the base paper reaches a prescribed value, 0.8 parts by weight of amphoteric starch, 0.8 parts by weight of aluminum sulfate and 1.0 parts by weight of an alkyl ketene dimer-based sizing agent (Sizepine K903, Arakawa Chemical Industries, Ltd.), was formed into paper with a Fourdrinier papermaking machine, followed by subjecting to machine calendering treatment, resulting in the fabrication of base paper having a basis weight of 68.9 g/m$^2$, 53.2 g/m$^2$ or 41.3 g/m$^2$. During fabrication of the base paper, the printing paper used in each example and comparative example was suitably adjusted for base paper ash content, pulp freeness and ratio of pulp jet speed/Fourdrinier wire speed (J/W ratio) so as to have the respective specific tensile strengths in the CD direction and MD direction described in Table 1.

<Preparation of Coating Layer-Coating Color>

The coating layer-coating color was prepared using the components indicated below.

| | |
|---|---|
| Ground calcium carbonate | 50 parts by weight |
| Precipitated calcium carbonate | 50 parts by weight |
| Polyvinyl alcohol | 10 parts by weight |
| Starch phosphate | 10 parts by weight |
| Water-soluble polyvalent cation salt | Amount shown in Table 1 |

The aforementioned components were combined and then mixed and dispersed in water followed by adjusting to a solid content concentration of 40% by weight.

The ash content of the base paper refers to the ratio (wt %) of the weight of incombustible matter after subjecting the base paper to combustion treatment for 1 hour at 500° C. to the bone dry weight of the base paper prior to combustion treatment.

TABLE 1

| | Base paper basis weight g/m$^2$ | Amounts of LBKP/NBKP Parts by weight | LBKP freeness ml | NBKP freeness ml | Base paper ash content wt % | Water-soluble polyvalent cation salt Parts by weight | Printing paper specific tensile strength CD direction N · m/g | MD direction N · m/g | Ratio |
|---|---|---|---|---|---|---|---|---|---|
| Ex. 1 | 53.2 | 100/0 | 500 | — | 23.0 | 10 | 8.0 | 16.1 | 2.0 |
| Ex. 2 | 53.2 | 100/0 | 500 | — | 23.0 | 10 | 7.7 | 16.7 | 2.2 |
| Ex. 3 | 53.2 | 100/0 | 500 | — | 27.0 | 10 | 7.8 | 14.9 | 1.9 |
| Ex. 4 | 53.2 | 100/0 | 500 | — | 23.0 | 0 | 8.0 | 16.1 | 2.0 |
| Ex. 5 | 53.2 | 100/0 | 500 | — | 23.0 | 0 | 7.7 | 16.7 | 2.2 |
| Ex. 6 | 53.2 | 100/0 | 500 | — | 27.0 | 0 | 7.8 | 14.9 | 1.9 |
| Ex. 7 | 53.2 | 100/0 | 500 | — | 20.0 | 10 | 9.0 | 18.3 | 2.0 |
| Ex. 8 | 53.2 | 100/0 | 500 | — | 30.0 | 10 | 7.0 | 14.1 | 2.0 |
| Ex. 9 | 53.2 | 70/30 | 500 | 520 | 23.0 | 10 | 8.2 | 16.5 | 2.0 |
| Ex. 10 | 53.2 | 70/30 | 480 | 450 | 23.0 | 10 | 8.4 | 17.0 | 2.0 |
| Ex. 11 | 53.2 | 70/30 | 450 | 430 | 23.0 | 10 | 8.5 | 17.2 | 2.0 |
| Ex. 12 | 41.3 | 100/0 | 500 | — | 23.0 | 10 | 7.1 | 14.3 | 2.0 |
| Ex. 13 | 41.3 | 70/30 | 500 | 520 | 23.0 | 10 | 7.8 | 15.9 | 2.0 |
| Ex. 14 | 41.3 | 70/30 | 480 | 500 | 23.0 | 10 | 8.1 | 16.1 | 2.0 |
| Ex. 15 | 41.3 | 70/30 | 480 | 450 | 23.0 | 10 | 8.2 | 16.2 | 2.0 |
| Ex. 16 | 41.3 | 70/30 | 450 | 430 | 23.0 | 10 | 8.3 | 16.4 | 2.0 |
| Ex. 17 | 68.9 | 100/0 | 500 | — | 23.0 | 10 | 8.5 | 17.8 | 2.1 |
| Ex. 18 | 68.9 | 70/30 | 500 | 520 | 23.0 | 10 | 8.8 | 18.1 | 2.1 |
| Ex. 19 | 68.9 | 70/30 | 480 | 500 | 23.0 | 10 | 9.0 | 18.6 | 2.1 |
| Ex. 20 | 68.9 | 70/30 | 500 | 480 | 23.0 | 10 | 8.9 | 18.4 | 2.1 |
| Ex. 21 | 53.2 | 100/0 | 500 | — | 23.0 | 10 | 7.7 | 16.7 | 2.2 |

TABLE 1-continued

| | Base paper basis weight g/m$^2$ | Amounts of LBKP/NBKP Parts by weight | LBKP freeness ml | NBKP freeness ml | Base paper ash content wt % | Water-soluble polyvalent cation salt Parts by weight | Printing paper specific tensile strength CD direction N · m/g | MD direction N · m/g | Ratio |
|---|---|---|---|---|---|---|---|---|---|
| Ex. 22 | 53.2 | 100/0 | 500 | — | 23.0 | 10 | 7.8 | 16.9 | 2.2 |
| Ex. 23 | 53.2 | 100/0 | 500 | — | 23.0 | 10 | 7.7 | 16.7 | 2.2 |
| Comp. Ex. 1 | 53.2 | 100/0 | 500 | — | 23.0 | 0 | 11.1 | 12.4 | 1.1 |
| Comp. Ex. 2 | 53.2 | 100/0 | 500 | — | 23.0 | 0 | 9.3 | 14.1 | 1.5 |
| Comp. Ex. 3 | 53.2 | 100/0 | 450 | — | 18.5 | 0 | 10.3 | 18.7 | 1.8 |
| Comp. Ex. 4 | 53.2 | 100/0 | 450 | — | 18.5 | 0 | 14.0 | 14.3 | 1.0 |
| Comp. Ex. 5 | 53.2 | 100/0 | 450 | — | 18.5 | 0 | 11.1 | 16.2 | 1.5 |
| Comp. Ex. 6 | 41.3 | 70/30 | 500 | 520 | 23.0 | 0 | 11.4 | 12.8 | 1.1 |
| Comp. Ex. 7 | 41.3 | 70/30 | 480 | 450 | 23.0 | 0 | 11.9 | 13.0 | 1.1 |
| Comp. Ex. 8 | 41.3 | 70/30 | 450 | 430 | 23.0 | 0 | 12.3 | 13.0 | 1.1 |
| Comp. Ex. 9 | 53.2 | 100/0 | 500 | — | 23.0 | 10 | 11.1 | 12.4 | 1.1 |
| Comp. Ex. 10 | 53.2 | 100/0 | 500 | — | 23.0 | 10 | 9.3 | 14.1 | 1.5 |

Calcium chloride was used for the water-soluble polyvalent cation salt in Examples 1 to 3 and Examples 7 to 20. Calcium nitrate was used for the water-soluble polyvalent cation salt in Example 21. Calcium formate was used for the water-soluble polyvalent cation salt in Example 22. Magnesium chloride was used for the water-soluble polyvalent cation salt in Example 23.

The printing paper of each of the examples and comparative examples was produced according to the procedure described below.

<Production of Printing Paper>

A coating layer-coating color was coated onto both sides of the base paper using a film transfer coater at a coated amount of 5 g/m$^2$ per side followed by drying to fabricate paper. Next, calendering treatment was carried out on the resulting paper to fabricate printing paper. Calendering was carried out using an elastic roller and metal roller in a linear pressure range of 75 kN/m to 85 kN/m over a range of nip linear pressure that allowed the obtaining of a suitable thickness profile in the direction of width. The temperature of the metal roller was made to be 40° C.

The resulting printing paper was evaluated according to the methods indicated below. The evaluation results are shown in Table 2.

TABLE 2

| | Evaluation of cockling | Evaluation of wrinkling | Evaluation of curling |
|---|---|---|---|
| Ex. 1 | 4 | 4 | 4 |
| Ex. 2 | 4 | 4 | 4 |
| Ex. 3 | 3 | 2 | 3 |
| Ex. 4 | 3 | 4 | 2 |
| Ex. 5 | 3 | 4 | 2 |
| Ex. 6 | 3 | 2 | 2 |
| Ex. 7 | 2 | 3 | 4 |
| Ex. 8 | 3 | 2 | 2 |
| Ex. 9 | 4 | 4 | 4 |
| Ex. 10 | 4 | 3 | 3 |
| Ex. 11 | 3 | 3 | 3 |

TABLE 2-continued

| | Evaluation of cockling | Evaluation of wrinkling | Evaluation of curling |
|---|---|---|---|
| Ex. 12 | 3 | 2 | 2 |
| Ex. 13 | 4 | 4 | 4 |
| Ex. 14 | 4 | 4 | 4 |
| Ex. 15 | 3 | 2 | 2 |
| Ex. 16 | 2 | 2 | 2 |
| Ex. 17 | 4 | 4 | 4 |
| Ex. 18 | 4 | 4 | 4 |
| Ex. 19 | 4 | 4 | 4 |
| Ex. 20 | 4 | 4 | 4 |
| Ex. 21 | 4 | 4 | 4 |
| Ex. 22 | 4 | 4 | 4 |
| Ex. 23 | 3 | 4 | 3 |
| Comp. Ex. 1 | 2 | 3 | 1 |
| Comp. Ex. 2 | 2 | 3 | 1 |
| Comp. Ex. 3 | 1 | 2 | 1 |
| Comp. Ex. 4 | 1 | 2 | 1 |
| Comp. Ex. 5 | 1 | 2 | 1 |
| Comp. Ex. 6 | 3 | 1 | 1 |
| Comp. Ex. 7 | 2 | 1 | 1 |
| Comp. Ex. 8 | 1 | 1 | 1 |
| Comp. Ex. 9 | 2 | 3 | 1 |
| Comp. Ex. 10 | 2 | 3 | 1 |

<Measurement of Specific Tensile Strength>

Specific tensile strength in the CD direction and specific tensile strength in the MD direction of the printing paper were measured according to a method basically in compliance with JIS P 8113:2006. More specifically, the test sample was subject to humidity preconditioning treatment by still standing the test sample under the environment at 23° C. and 50% RH for 24 hours. The basis weight of the test sample was measured under the environment at 23° C. and 50% RH. Tensile test was carried out under the environment at 23° C. and 50% RH to obtain the specific tensile strength. The Tensilon Universal Testing Machine manufactured by Orientec Co., Ltd. was used for the measuring device.

<Evaluation of Cockling>

Printing was carried out with a rotary inkjet printing press manufactured by the Hewlett-Packard Co. (HP T300 Color Inkjet Web Press) at a printing speed of 120 m/min using CMYK 4-color ink. A portion of the printing paper that was taken up after printing was arbitrarily cut to a size of 1 m×1 m followed by visual evaluation of any cockling present to one of the four ranks indicated below. In the present invention, a rank of 2 to 4 indicates that the occurrence of cockling was inhibited.

4: Extremely favorable inhibition with no cockling observed

3: Favorable inhibition although slight cockling observed

2: Cocking observed, but not to a degree that presents problems in terms of practical use 1: Cocking observed to a degree that presents problems in terms of practical use <Evaluation of Wrinkling>

Printing was carried out with a rotary inkjet printing press manufactured by the Hewlett-Packard Co. (HP T300 Color Inkjet Web Press) at a printing speed of 120 m/min using CMYK 4-color ink. During printing, wrinkling occurring in the printing paper around the time of the drying step of the printing press was visually evaluated to one of the four ranks indicated below. In the present invention, a rank of 2 to 4 indicates that the occurrence of cockling was inhibited.

4: Extremely favorable inhibition with no wrinkling observed

3: Favorable inhibition although slight wrinkling observed

2: Wrinkling observed, but not to a degree that presents problems in terms of practical use 1: Wrinkling observed to a degree that presents problems in terms of practical use <Evaluation of Curling>

Printing was carried out with a rotary inkjet printing press manufactured by the Hewlett-Packard Co. (HP T300 Color Inkjet Web Press) at a printing speed of 120 m/min using CMYK 4-color ink. A portion of the printing paper that was taken up after printing was arbitrarily cut to A4 size with the long side in the MD direction. The cut A4-size printing paper was allowed to stand for 24 hours at normal temperature and normal humidity followed by visually evaluating any curling present to one of the four ranks indicated below. In the present invention, a rank of 2 to 4 indicates that the occurrence of curling was inhibited.

4: Favorable inhibition with hardly any curling observed

3: Favorable inhibition with some curling observed

2: Curling observed, but not to a degree that presents problems in terms of practical use 1: Curling observed to a degree that presents problems in terms of practical use Based on the results of Table 2, Examples 1 to 23 corresponding to the present invention were determined to inhibit the occurrence of cockling and wrinkling and to inhibit the occurrence of curling after printing when released from the rolled state and cut into sheets, in the case where inkjet printing is carried out in a rotary inkjet printing press while tension is applied from the time the printing paper is rolled out until it is taken up. Comparative Examples 1 to 10 not corresponding to the present invention were determined to not allow the effects of the present invention to be obtained.

In addition, primarily on the basis of a comparison of Examples 2, 12 and 17 with Examples 9 to 11, Examples 13 to 16 and Examples 18 to 20, it was determined to be more preferable that the base paper at least contain LBKP and NBKP as pulp and that it satisfies the relationship of (LBKP freeness)<(NBKP freeness) particularly when the base paper has a low basis weight.

In addition, primarily on the basis of a comparison of Examples 1 to 3, 7 and 8 and Examples 21 to 23 with Examples 4 to 6, it was determined to be preferable that the coating layer contains a water-soluble polyvalent cation salt.

In addition, primarily on the basis of a comparison of Examples 2 21 and 22 with Example 23, it was determined to be preferable that the water-soluble polyvalent cation salt is a calcium salt.

What is claimed is:

1. Printing paper comprising:

a base paper and a coating layer containing a pigment and a binder on at least one side of the base paper; wherein, an ash content of the base paper is 20% by weight to 30% by weight, and specific tensile strength of the printing paper in the CD direction is 9.0 N·m/g or less, and the ratio of (specific tensile strength in the MD direction)/(specific tensile strength in the CD direction) is 1.9 to 2.3, wherein the specific tensile strength is as determined basically in compliance with JIS P 8113:2006.

2. The printing paper according to claim 1, wherein the base paper contains at least leaf bleached kraft pulp (LBKP) and needle bleached kraft pulp (NBKP) as pulp, and the relationship of the freeness of the LBKP and NBKP as determined basically in compliance with the "Canada Standard Freeness Method" of JIS P 8121-2:2012 is such that (LBKP freeness)<(NBKP freeness).

3. The printing paper according to claim 1, wherein the coating layer contains a water-soluble polyvalent cation salt.

4. The printing paper according to claim 2; wherein the coating layer contains a water-soluble polyvalent cation salt.

5. A method for producing a printed material, comprising the steps of:

obtaining the printing paper according to claim 1, and obtaining a printed material by printing on the printing paper with an industrial rotary inkjet printing press.

6. A method for producing a printed material, comprising the steps of:

obtaining the printing paper according to claim 2, and obtaining a printed material by printing on the printing paper with an industrial rotary inkjet printing press.

7. A method for producing a printed material, comprising the steps of:

obtaining the printing paper according to claim 3, and obtaining a printed material by printing on the printing paper with an industrial rotary inkjet printing press.

8. A method for producing a printed material, comprising the steps of:

obtaining the printing paper according to claim 4, and obtaining a printed material by printing on the printing paper with an industrial rotary inkjet printing press.

* * * * *